US006066080A

United States Patent [19]

Benoit et al.

[11] Patent Number: 6,066,080

[45] Date of Patent: May 23, 2000

[54] METHOD AND MACHINE FOR AUTOMATICALLY GLUING A HEAT SHRINKABLE PLASTIC FILM ONTO THE BOTTOM OF AN OPEN BOX

[75] Inventors: Jean-Louis Benoit, Brazey En Plaine; Bernard Broye, Dijon; Alain Lucotte, Villy le Moutier, all of France

[73] Assignee: Societe Cermex, Corcelles les Citeaux, France

[21] Appl. No.: 09/105,466

[22] Filed: Jun. 26, 1998

[30] Foreign Application Priority Data

Jun. 26, 1997 [FR] France ..... 97 08017

[51] Int. Cl.[7] ..... B31B 7/02

[52] U.S. Cl. ..... 493/95; 493/93

[58] Field of Search ..... 493/95, 93, 907, 493/906; 53/175

[56] References Cited

U.S. PATENT DOCUMENTS

| | | | |
|---|---|---|---|
| 1,940,743 | 12/1933 | Campbell | 93/36 |
| 2,065,828 | 12/1936 | Schnur | 93/36.01 |
| 2,704,013 | 3/1955 | Reynolds et al. | 93/36.01 |
| 2,736,065 | 2/1956 | Wilcox | 18/56 |
| 2,871,773 | 2/1959 | Verrinder | 93/36.01 |
| 3,584,432 | 6/1971 | Mayer, Jr. | 53/61 |
| 3,986,597 | 10/1976 | Valentino | 198/358 |
| 4,009,646 | 3/1977 | Mott | 93/36.01 |
| 4,226,170 | 10/1980 | Christensson | 93/36.01 |
| 4,461,236 | 7/1984 | Langenbach | 118/50 |
| 4,586,613 | 5/1986 | Horii | 209/556 |
| 4,687,462 | 8/1987 | Rewitzer | 493/100 |
| 4,998,502 | 3/1991 | Schucker | 118/667 |
| 5,334,249 | 8/1994 | Osborn | 118/679 |
| 5,501,571 | 3/1996 | Van Durrett et al. | 414/786 |

FOREIGN PATENT DOCUMENTS

| | | |
|---|---|---|
| 0 618 066 | 10/1994 | European Pat. Off. . |
| 2 661 392 | 10/1991 | France . |
| 8 501 319 | 12/1986 | Netherlands . |

*Primary Examiner*—Lowell A. Larson
*Assistant Examiner*—William Hong
*Attorney, Agent, or Firm*—Young & Thompson

[57] ABSTRACT

A method and machine for gluing a heat shrinkable film (9) onto the bottom of a rigid container (1) that is open at its upper part and has a rectangular or square horizontal section remarkable in that the containers are moved on an endless conveyor (2) that extends longitudinally and in that for each new container (1) that arrives, its height (h) and/or its dimension (a) in the transverse direction is measured and that then from the measurement of the height (h) and/or the dimension (a) in the transverse direction of each container, a glue application device (6) and a device (7) for applying the film is adjusted in relation to the corresponding dimensions of each container (1) in such a way as to position these devices as close as possible to the upper edges of the containers and/or to follow the variations in their transverse dimension (a).

16 Claims, 5 Drawing Sheets

METHOD AND MACHINE FOR AUTOMATICALLY GLUING A HEAT SHRINKABLE PLASTIC FILM ONTO THE BOTTOM OF AN OPEN BOX

FIELD OF THE INVENTION

This invention relates to a method and a machine for automatically gluing a heat shrinkable plastic film onto the bottom of a rigid container, open at its upper part and with a rectangular or square horizontal section.

BACKGROUND OF THE INVENTION

For the shipping of groups of diverse products corresponding to different orders, containers made of cardboard or similar materials are being used more and more at the present time, containers such as American boxes or American half-boxes, trays, etc . . . onto the bottom of which the central part of a section of heat shrinkable plastic film is glued, the end parts of which are left free in order to be able to be folded over the products grouped together in the container following preparation of an order. After placing the group of products in the container, the container is passed through a shrinking tunnel and the plastic film then shrinks onto the products holding them firmly in place inside the container, which avoids having to use additional fixing elements.

DESCRIPTION OF THE INVENTION

The aim of this invention is to provide a method and a machine which allows the production of order preparation packaging at a high rate, on a serial production basis, by automatically adapting itself to variations in the height and/or the horizontal section of successive containers.

SUMMARY OF THE INVENTION

To this end, this method of automatically gluing a heat shrinkable plastic film onto the bottom of a rigid container open at its upper part and with a rectangular or square horizontal section, is characterized in that the containers are moved, one after the other, on an endless conveyor extending longitudinally, and in that for each new container that arrives, one measures its height and/or its dimension in the transverse direction, that is to say perpendicular to the direction of advancement of the containers on the conveyor, and that then from the measurement of the height and/or the dimension in the transverse direction of each container, the vertical position and/or the transverse extension of a glue application device and a device for applying the film is adjusted in relation to the corresponding dimensions of each container in such a way as to position these devices as close as possible to the upper edge of each container and/or to follow the variations in the transverse dimension of each container.

Another object of the invention is a machine for automatically gluing a heat shrinkable plastic film onto the bottom of a rigid container open at its upper part and with a horizontal or square section, comprising a horizontal endless conveyor driven intermittently, a stand-by station located at the upstream end part of the conveyor onto which the successive containers are placed and, downstream from this stand-by station, a station for the application of the film on the upper part of which is situated a device for applying a section of thermoplastic film onto the bottom of each container, characterized in that it comprises, between the stand-by station and the station for the application of the film, a glue application device for projecting the glue, from the top, onto the bottom of each container, during its longitudinal displacement between these two stations, means for placing and keeping the containers in position, on the conveyor, in such a way that one of their longitudinal sides is always situated in one and the same vertical and longitudinal reference plane, means of measuring the height and/or the transverse dimension of each container at the stand-by station and means of adjusting the vertical position and/or the transverse extension of the glue application device and the plastic film application device in relation to the height and/or the transverse dimension of each container in such a way that these two devices are positioned as close as possible to the upper edge of each container, whatever its height and/or to make the transverse extension of these two glue and film application devices correspond to the transverse dimension of each container.

BRIEF DESCRIPTION OF THE DRAWINGS

Below, by way of non-limitative examples, various ways of carrying out this invention will be described, making reference to the appended drawings in which.

DETAILED DESCRIPTION OF THE DRAWINGS

Figure 1:
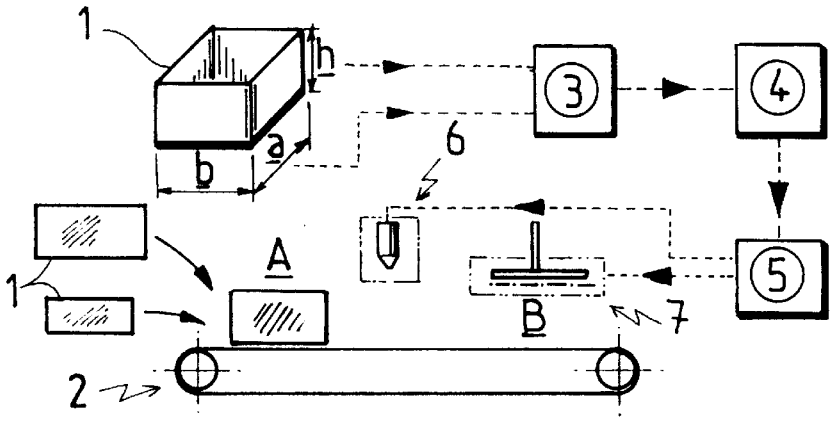
FIG. 1 is a diagrammatic view in vertical and longitudinal section of a machine according to the invention and of a container before the gluing of a thermo-plastic film onto its bottom, during the initial stage of a cycle of the machine.

First to be described, making reference to FIGS. 1 to 9, will be the different steps in the method of automatic gluing a heat shrinkable plastic film onto the bottom of a rigid container 1 open at its upper part and with a rectangular or square horizontal section, this method being implemented in a machine represented very diagramatically. In FIG. 1, several containers 1 are represented having a variable height h and a horizontal section having a variable transverse dimension a and a longitudinal dimension b. In the description that will follow, the expression "longitudinal" is to be understood as referring to the longitudinal direction of displacement, from left to right on the drawn Figures, of the containers on a horizontal and longitudinal conveyor 2 of any suitable type, the expression "transverse" referring to the direction perpendicular to the preceding one. To put it another way, each container 1 is placed, by any suitable means, on the upstream end or left part A of the endless conveyor, then at a standstill, that constitutes a stand-by station. While the container 1 is at a standstill at the stand-by station or before its arrival at this station, its height h and its transverse section and more particularly its transverse dimension a are measured. This measurement step is represented by block 3 on FIG. 1. The result of these measurements is transmitted to a general command apparatus 4 which acts on a device 5 controlling the setting of the vertical position and/or the transverse extension of a glue application device 6 and a film application device. The film application device 7 is situated above the downstream end part of the conveyor 2, defining a film application station B. The glue application device 6 can be independent of the film application device 7 or linked to it.

During the first step of the method according to this invention, that is to say while the container 1 is immobile at the stand-by station A, the vertical position of devices 6 and 7 is set automatically from the measurements of the height h and/or the transverse dimension a of the container 1, in such a way that they are situated as close as possible to the upper edge of the container 1, and/or the transverse extension of these devices is set in such a way that it corresponds to the transverse dimension a of the container.

Once suitable settings for devices 6 and 7 have been made, one proceeds to the second step of the method which consists of projecting the glue onto the bottom of the container 1 by means of the device 6 which includes gluing nozzles directed downwards.

Figure 2:
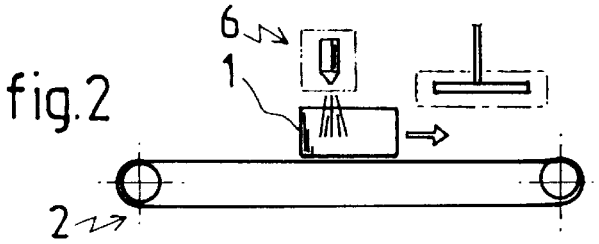
FIG. 2 is a diagrammatic view in vertical and longitudinal section illustrating the container during glue application.

The glue application step can be carried out by causing a longitudinal displacement of the glue application device 6 above the container 1 held immobile on the conveyor 2. According to a variant, the glue application can take place, as illustrated in FIG. 2, during the displacement of the container 1 from the stand-by station A toward the film application station B. In this case, the glue application device 6 has a fixed longitudinal position and it can then be linked to the film application device 7, being located on the upstream or left side of it in such a way as to be able to be displaced vertically conjointly with device 7.

Figure 3:
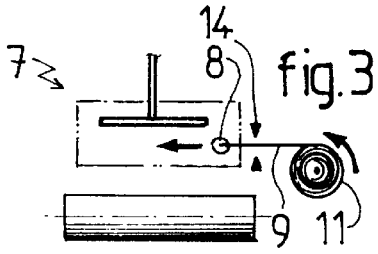
FIG. 3 is a diagrammatic view in vertical and longitudinal section illustrating the phase of the transverse drawing of the film.

FIG. 3 illustrates diagramatically, the drawing in the transverse direction, by means of a movable grip 8, of the thermoplastic shrinkable film 9 which is wound from a lateral roll 11 located at the film application station B. The mobile grip 8 with transverse movement is part of the film application device 7 as will be described in greater detail below.

Figure 4:
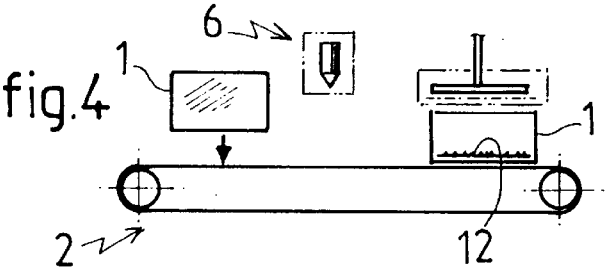
FIG. 4 is a diagrammatic view in vertical and longitudinal section of the machine illustrating the container which has arrived at the film application station.
Figure 5:
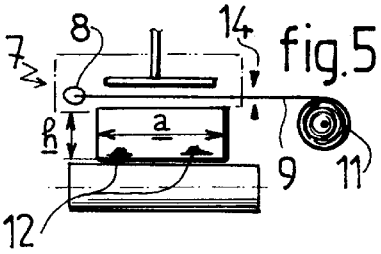
FIG. 5 is a view in vertical and longitudinal section illustrating the film application station after the complete transverse drawing of the film across and above the container.

FIGS. 4 and 5 represent the container 1 which has arrived at the film application station B and is at rest at this station before application of the film 9 onto its glued bottom. On these Figures, longitudinal strips of glue 12 have been shown, which have been previously projected onto the bottom of the container 1, by the glue application device 6. In FIG. 5, it can be seen that the film 9 has been drawn across and above the container 1 and beyond it, over a variable length which depends on its height h and/or its transverse dimension a. While the container 1, with its bottom glued, is at station B, a new container 1 of identical or different height h and/or identical or different transverse dimension a, is positioned at the stand-by station A.

Figure 6:
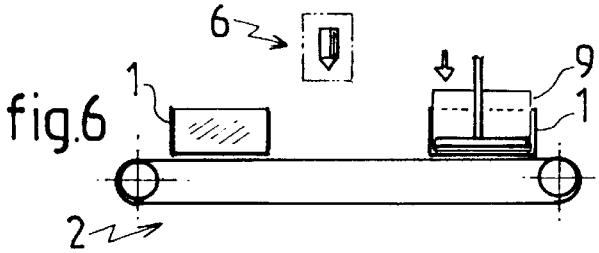
FIG. 6 is a diagrammatic view in vertical and longitudinal section of the machine illustrating the pressing of the film onto the bottom of the container to which glue has been applied.
Figure 7:
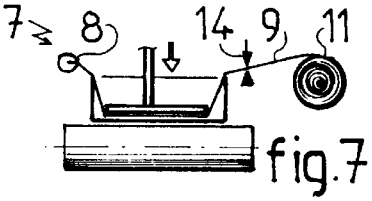
FIG. 7 is a diagrammatic view in vertical and longitudinal section of the film application station during the pressing of the film.

The following step of the method is constituted by the pressing of the film 9 to the interior of the container 1, in such a way that it is applied against the bottom of the container 1, as illustrated in FIGS. 6 and 7. To this end, a vertically mobile pressing head 13, which forms part of the device 7 for applying the film 9, and which is situated above this film, is lowered in such a way that it is introduced into the container and applies the film 9 with pressure against the bottom of the container 1, for a period of time, of the order of 2 seconds for example, that is sufficient to ensure effective bonding. During the final part of the pressing, a cutting device 14 is actuated to separate the section of film which is stuck to the inside of the container 1 from the supply roll 11.

Figure 8:
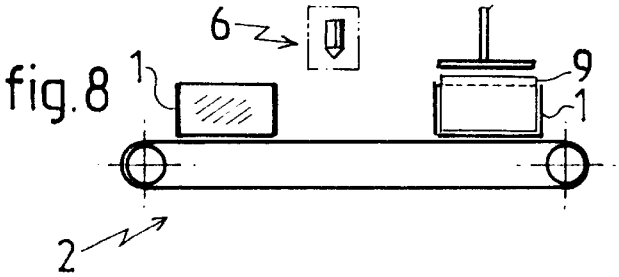
FIG. 8 is a diagrammatic view in vertical and longitudinal section of the container released after the pressing of the film onto the bottom to which glue has been applied.
Figure 9:
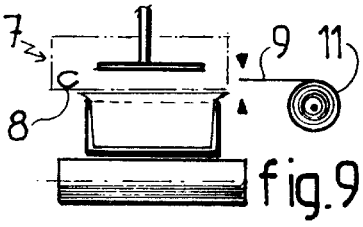
FIG. 9 is a diagrammatic view in vertical and longitudinal section of the film application station after the pressing of the film and the release of the container.

After the period of time provided for the pressing has passed, the pressing head 13 is moved upwards in such a way that it is clear of the container 1, as is represented in FIGS. 8 and 9. The container 1, fitted with the section of heat shrinkable film 9, the central part of which is glued to the bottom of the container 1 and whose end parts are free, can then be moved on when the conveyor is set going again.

A non-limitative embodiment of a machine for implementing the method according to this invention will now be described making reference to FIGS. 10 to 13.

Figure 10:
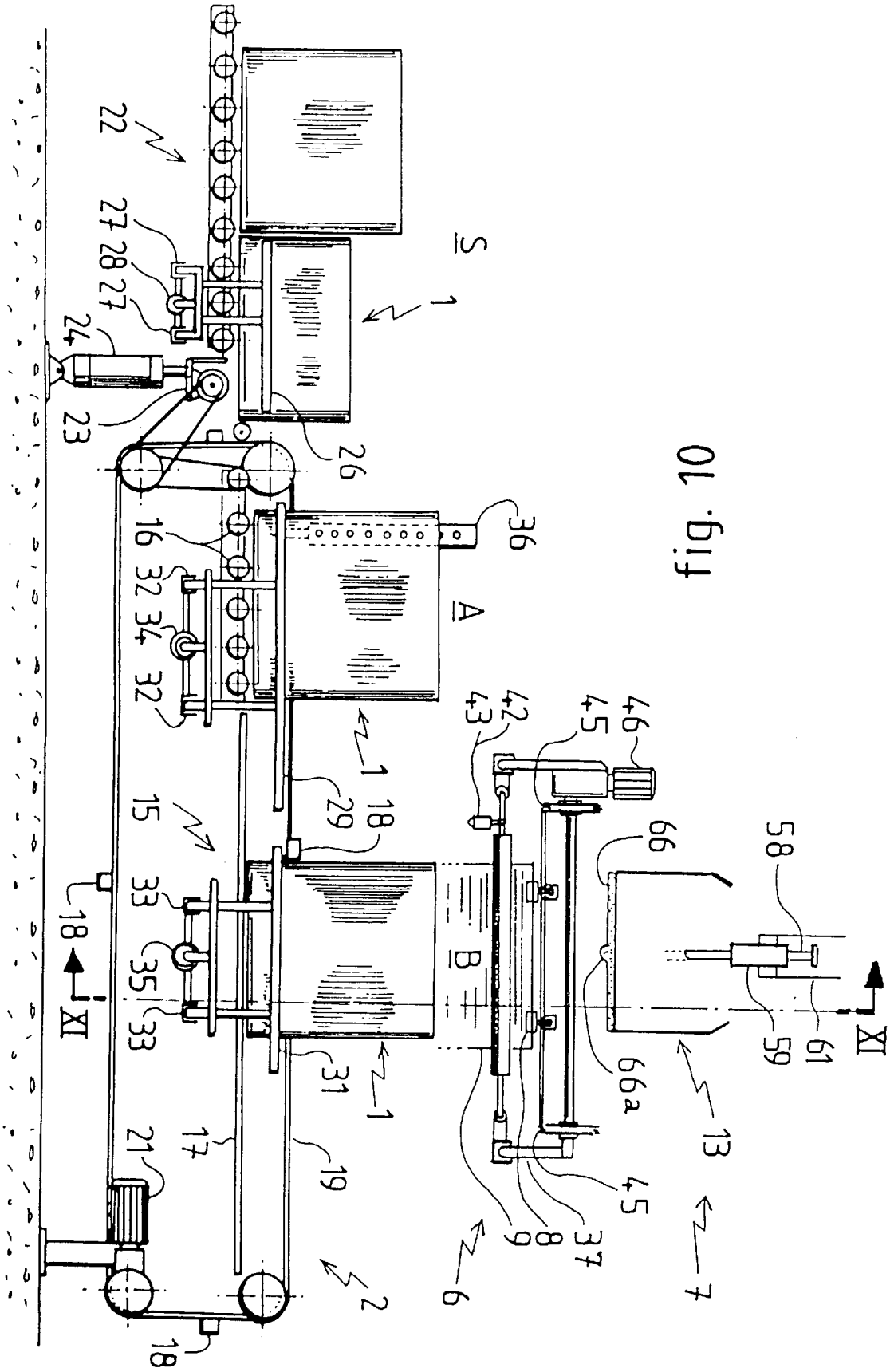
FIG. 10 is a simplified view in vertical and longitudinal section of an embodiment of a machine according to this invention, operating on containers of different heights and/or with different horizontal sections.
Figure 11:
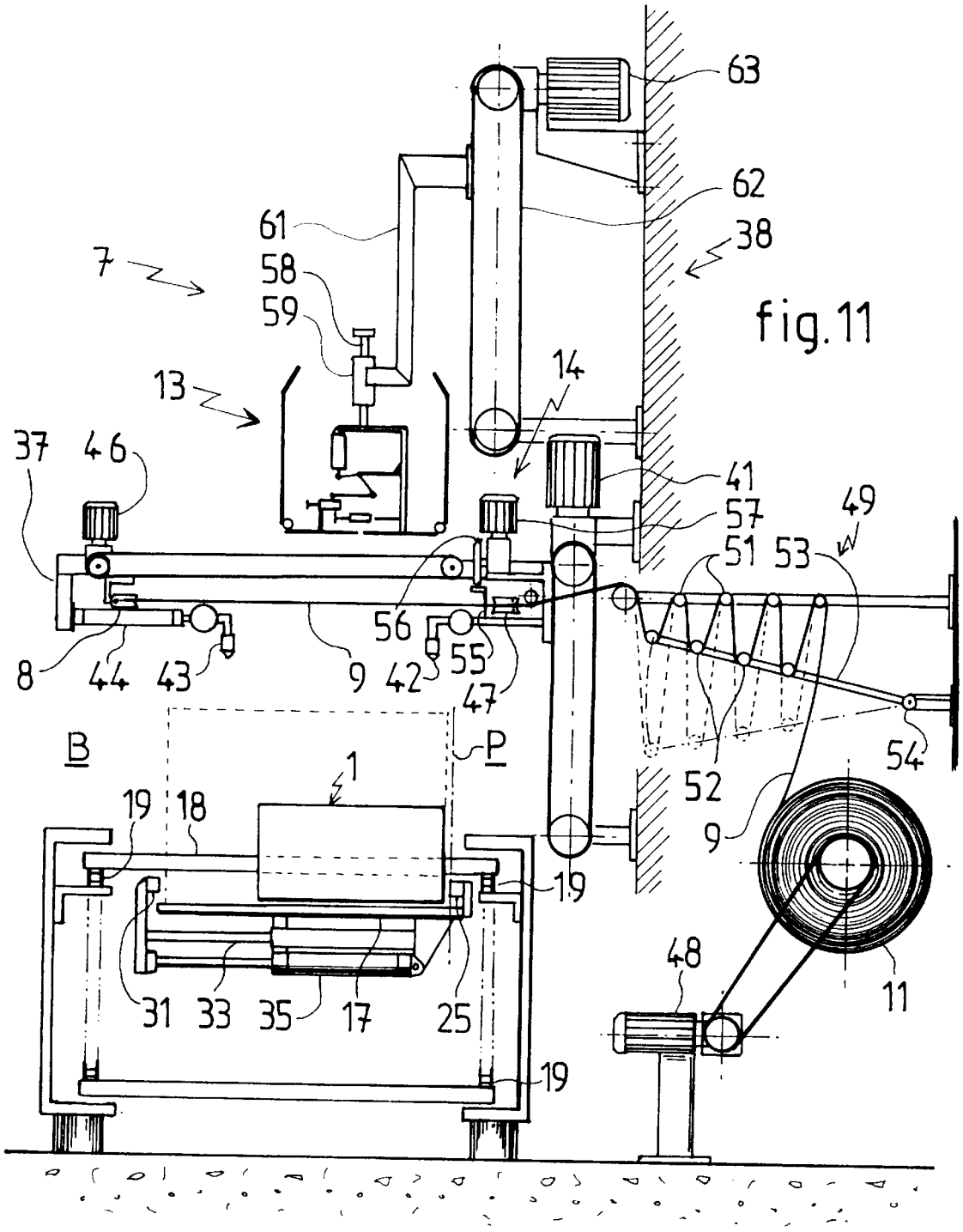
FIG. 11 is a view in vertical and transverse section taken along the line XI—XI in FIG. 10.

In the embodiment represented in FIGS. 10 and 11, the endless conveyor 2 which causes the successive displacement of the various containers 1, comprises a horizontal transfer path 15 the upstream end part of which is constituted by horizontal and transverse rollers 16 and the downstream part by a smooth plate 17. The various containers 1 are displaced on the rollers 16 and on the bedplate 17 by sliding on them and they are driven by transverse torque bars 18 attached, at their ends to endless chains 19 extending longitudinally on both side of the transfer path 15, and driven by a motor 21. The motor 21 is powered intermittently and the spacing between the torque bars 18 is chosen in such a way that, during each period that the motor 21 is running, each container 1 is driven from the stand-by station A to the film application station B or from this latter station onto a removal conveyor located in extension of the conveyor 2 and not represented.

Upstream of the conveyor 2 with intermittent movement and in alignment with it, there is a selection station S comprising a supply conveyor 22 of any suitable type, on which are placed the containers arriving one after the other. This conveyor 22 is situated at a level a little lower than that of the support rollers 16 of the endless conveyor 2 so that the upstream end roller 16 forms an abutment to stop each new container 1 arriving, thereby causing an accumulation of containers one after the other, on the supply conveyor 22. A selector 23, fitted with a raising and lowering system controlled by a jack 24, allows, at the appropriate moment in the machine's cycle, the levering up to a small extent of the downstream part of the first container 1 in the series of containers waiting on the supply conveyor 22, and causes it to pass onto the bed of rollers 16 in order to position it at the stand-by station A.

At the selection station S and at stations A and B there are, on one of the longitudinal sides of the conveyors, in this case on the right side in FIG. 11, longitudinal fixed guides 25 which are aligned, and which define a vertical and longitudinal reference plane P and against which one longitudinal side wall of the successive containers 1 is pressed. At the selection station there is also a lateral urging bar 26 which is situated opposite the corresponding fixed longitudinal guide 25, that is to say on the left side of the machine and which is transversely mobile, on slides 27, under the command of a jack 28. When the jack 28 is actuated in the appropriate direction, the urging bar 26 is displaced laterally towards the fixed guide 25 and it presses the container 1 which is between them against the fixed guide 25 so that its right longitudinal side wall is in the longitudinal reference plane P defined by the fixed guides 25. The extent of the displacement of the lateral urging bar 26 is also used, in this embodiment of the machine, to measure the transverse dimension a of each container 1. The measurement of the transverse dimension a is thereby taken and transmitted to the general command apparatus 4 (FIG. 1) and this commands the transverse displacement of mobile longitudinal guides 29, 31, which are respectively on the left side of the machine, that is to say opposite the fixed guides 25, at the site of stations A and B, in such a way that these mobile guides 29,31, servo-driven by the urging bar 26, come into longitudinal alignment at the distance a from the fixed guides 25 opposite, which corresponds to the transverse dimension a of the container 1 being dealt with.

The longitudinal guides 29,31 are movably mounted on respective transverse slides 32, 33 and their movements are commanded by respective transverse jacks 34, 35.

The height h of each container 1 is measured at the stand-by station A, by means, for example, of a set of superimposed photo-electric cells 36 arranged above the conveyor 2, and on one side of it. These photo-electric cells 36 or any other equivalent means are connected to the general command apparatus 4 in order to bring about the automatic setting of the vertical position of the film application device as a function of the height h of each container 1.

The film application station B will now be described in detailed fashion. The device 7 comprises, apart from the pressing head 13, a horizontal frame or apron 37 which is mounted in a vertically adjustable fashion on the base 38 of the machine. To this end, the right longitudinal side (FIG. 11) of the frame 37 is attached to a pair of vertical endless chains 39, movably mounted on the base 38 and driven by a motor 41 in such a way that the frame 37 can be vertically displaced and placed in a vertical position close to the top edge of each container 1 that is under it at station B, whatever the height h of this container may be.

The frame 37 carries several mobile assemblies. In a first place, in this non-limitative embodiment, it carries, on its upstream transverse side, nozzles that form part of the glue application device 6, the longitudinal position of which is fixed. More particularly, the glue application device comprises at least one vertical nozzle 42 and preferably two nozzles which are mounted in fixed positions on the frame, on the right side on FIG. 11, that is to say on the side of the vertical reference plane P, in such a manner that they project, onto the bottom of each container 1, pressed against the fixed reference guide 25, during its longitudinal displacement from station A to station B, one or two longitudinal strips of glue 12. To this end, the axes of the fixed nozzles 42 are slightly offset towards the interior, in relation to the fixed guides 25, in such a way that they project their jets of glue to the appropriate places on the bottom of each container 1. The glue application device 6 also comprises, at the same level as the fixed nozzle or nozzles 42, one or two opposite nozzles which are mounted in a transversely mobile fashion on the frame 37, under the command of at least one jack 44. The transverse position of the nozzle 43 or of each nozzle 43 can thus be adjusted as a function of the transverse dimension a of the container 1 that is under the frame 37. The nozzles 42, 43 are supplied with glue under pressure, during the longitudinal displacement of each container underneath them, under the command of a photo-electric cell that detects the passage of the container, the duration of the projection of the jets of glue being about 2 seconds.

The frame 37 also carries means that allow the transverse drawing of the plastic film 9 over the container 1. These means comprise the longitudinal mobile grip 8 which extends longitudinally and which is displaced transversely by transverse endless chains 45 movably mounted on the frame 37 and driven by a motor 46. The frame 37 also carries, on its right part, that is to say on the side of the vertical reference plane P, a longitudinal grip 47 in a fixed position. The opening and the closing of the mobile grip 8 and of the fixed grip 47 are caused by jacks which are themselves actuated by the general command apparatus 4 (FIG. 1).

The plastic film is unwound from the roll 11 which is situated on the right side of the machine at station B, and which is rotatably driven by a motor 48. The unrolled film 9 passes into a hoisting device 49 which includes fixed rollers 51 and mobile rollers 52 supported by an articulated arm 53 pivoting about a spindle 54. After having passed through the hoisting device 49, the film is taken up by the fixed grip 47. The unwinding of the roll 11 occurs between two cycles, while the end of the film 9 is held by the closed fixed grip 47. The articulated arm 53, mechanically commanded, carries out a downward rotation causing a certain length of film 9, constituting an available reserve of film, to be unwound. During the insertion of the film 9 into the container 1 by the pressing head 13, this allows the arm 53 of the hoisting device 49 which is then made free without any constraint, to come back to its high position under the effect of the traction of the film 9, as is shown in FIG. 11.

The frame 37 also carries the cutting device 14. This cutting device 14 comprises a vertical knife 55 which is situated proximate to the fixed grip 47, towards the inside. The knife 55 is rigidly fixed to an endless chain 56 extending horizontally and longitudinally, which is driven by a motor 57, in such a way that it can cut the film 9, in the transverse direction of this film, during the time at the end of it being pressed onto the bottom of the container 1.

As has been previously indicated, the film application device 7 also comprises, above the central opening of the frame 37, the pressing head 13 which is vertically and movably mounted on the base 38 of the machine. This pressing head 13 is rigidly fixed to a vertical arm 58 sliding in a vertical slide 59 rigidly fixed to a bracket 61. This bracket 61 is attached to vertical endless chains 62 which are supported by the base 38 and which are driven by a motor 63. When the motor 63 is switched on, in the appropriate direction, by the general command apparatus 4, this causes vertical movement of the pressing head 13 in order to lower it, through the central opening of the frame 37, to the inside of the container 1, so as to press the film 9 onto the glued bottom of the container, and in order to cause it to rise again, after pressing above the frame 37 as represented in FIG. 11.

Figure 12:
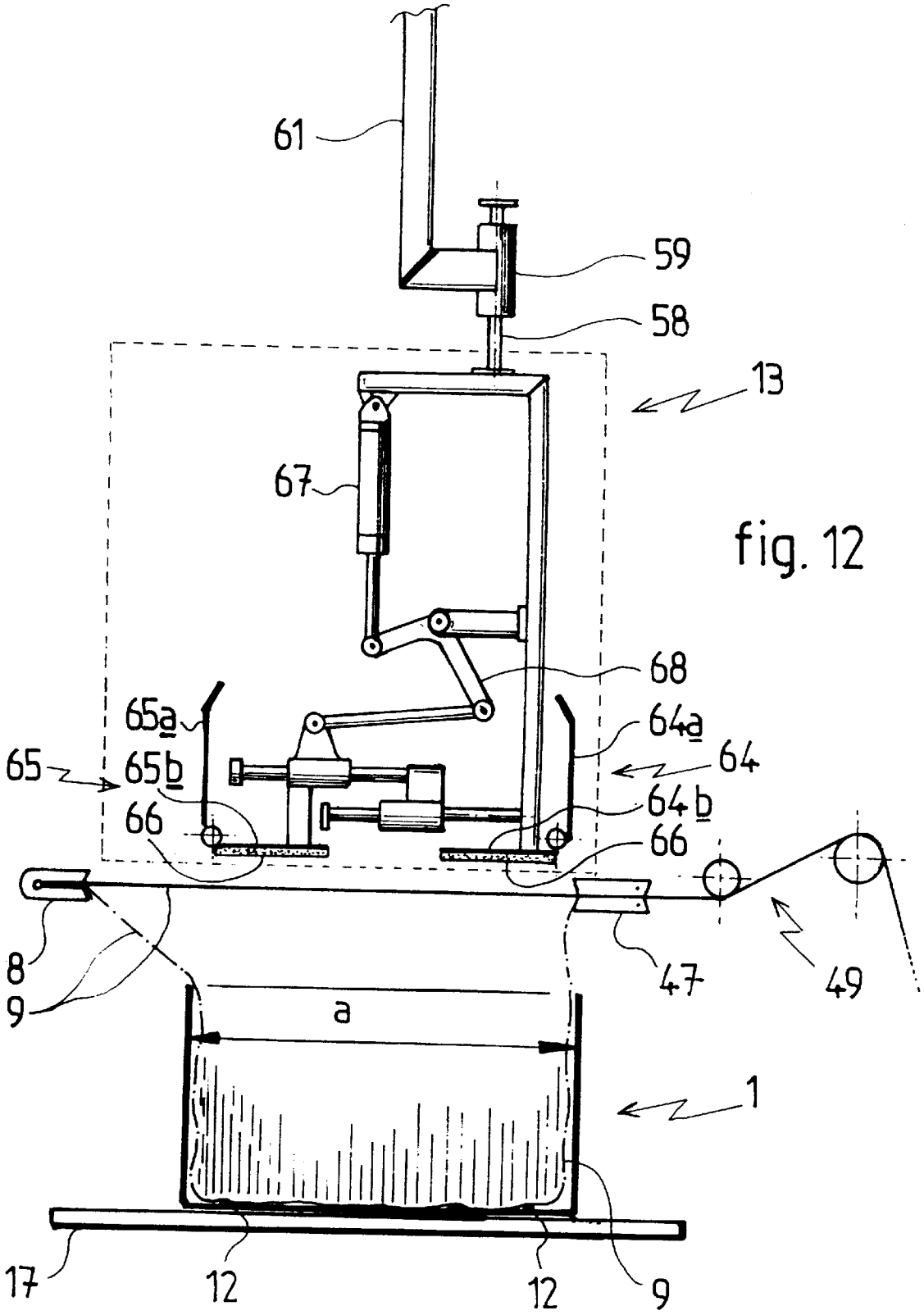
FIG. 12 is a diagrammatic view in vertical and transverse section of an extendible pressing head adjusted for a container with a small transverse dimension.
Figure 13:
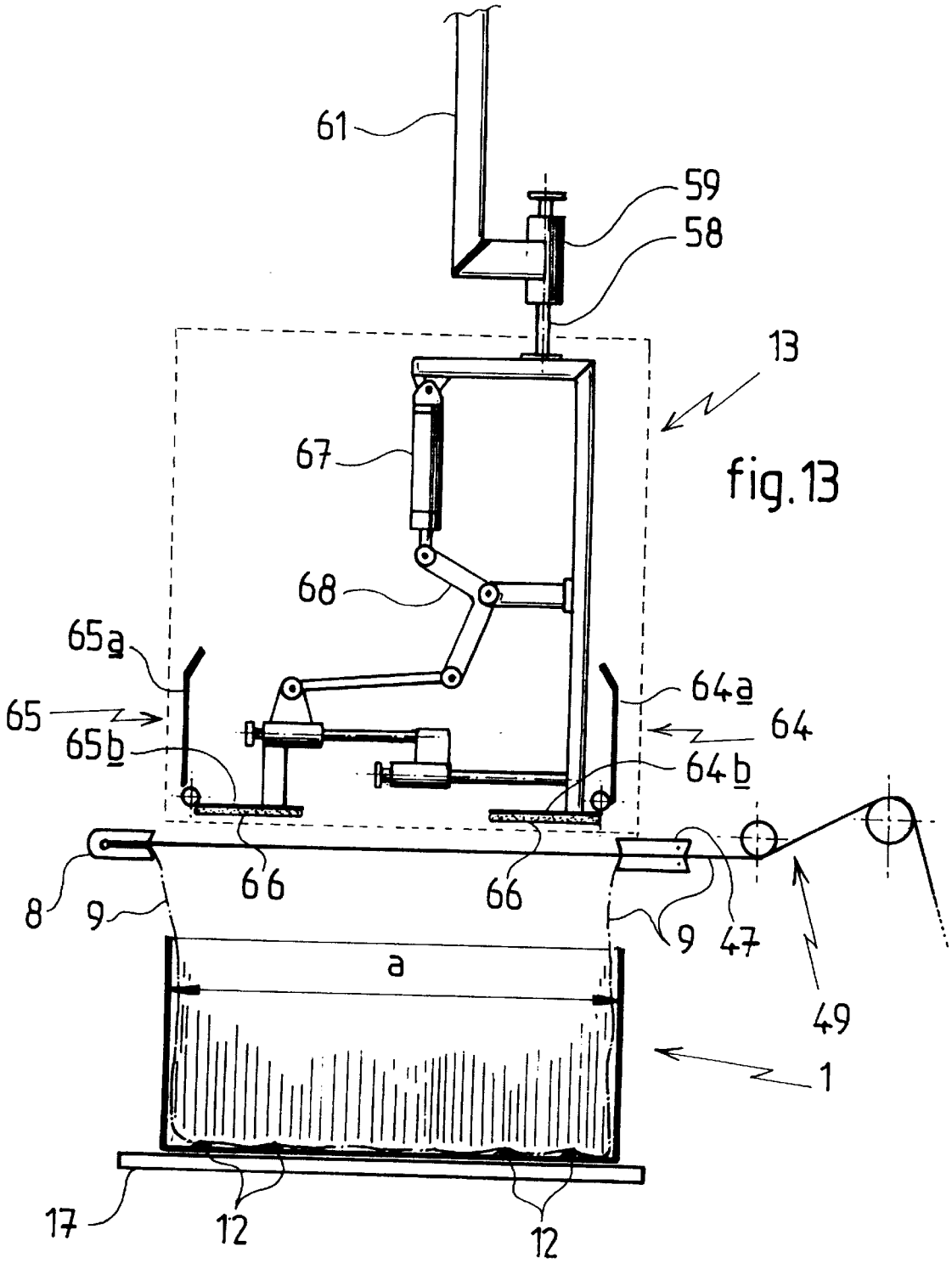
FIG. 13 is a diagrammatic view in vertical and transverse section of an extendible pressing head adjusted for a container with a large transverse dimension.

The pressing head can have a constant transverse dimension, if the transverse dimension a of the containers does not vary, or contrary to this it can be variable in the case where the machine operates with containers with a variable transverse dimension a. In this latter case, the pressing head 13 is extendible in the transverse direction and a non-limitative embodiment of this head is represented in FIGS. 12 and 13. The pressing head 13 includes in its lower part, two L-shaped pressing elements, namely a fixed pressing element 64 and a transversely mobile pressing element 65, each comprising a respective vertical plate 64*a*, 65*a* and a respective horizontal plate 64*b*, 65*b*. Each of the horizontal plates 64*b*, 65*b* which extend one towards the other, of the pressing elements 64, 65 is advantageously provided with a layer of an elastic material 66 such as a layer of foam on its lower face. The mobile pressing element 65 is displaced transversely under the command of a jack 67 by using a linking mechanism 68 with pivoting connecting rods and with slides, as is shown in FIGS. 12 and 13. Actuation of the jack 67, in one direction or in the other allows the pressing head 13 to be extended or retracted in the transverse direction so as to adapt it to the transverse dimension a of the container 1. At the time of the descent of the pressing head to the inside of the container 1, the horizontal plates 64*b*, 65*b* are applied, with the lower layers of foam that they are carrying, onto the film 9 which extends horizontally and they drive it downward as far as the bottom of the container 1, the head 13 is immobilized in the pressing position while the bracket 61 continues its descending travel. The plates 64*b*, 65*b* exert a pressure on the film 9 which is applied onto the strips of glue 12 previously deposited onto the bottom of the container.

In the case where the container 1 is a cardboard box with internal bottom flaps that are not joined, the layers of foam 66 advantageously have in their middle parts, transverse bosses 66*a* (FIG. 10) the width of which approximately correspond to the distance between the edges of the internal flaps, so as to be able to effectively press the film into the space between the edges of the internal flaps.

Advantageously the machine also comprises small air blowers which are associated with the film application device 7 and which allow one to fold back to the inside of the container the free end parts of the section of thermo-plastic film, only the central part of which is stuck to the bottom.

The machine according to the invention allows one to achieve a high rate of production of the order of 660 to 720 containers per hour, or 10 to 12 containers per minute.

We claim:

1. A method of automatically gluing a heat shrinkable plastic film onto a bottom of a rigid container from a plurality of containers, each container being open at its upper part and having a rectangular or square horizontal section, the method comprising:

displacing the containers one after the other on an endless conveyor which extends in a longitudinal direction of advancement;

measuring for each container advancing on the conveyor, the value of at least one of its height and a transverse dimension which is perpendicular to the direction of advancement; and setting from the measured value at least one of the vertical position and the transverse extension of a glue application device and of a plastic film applicator device as a function of the corresponding dimensions of each container such that at least one of conditions a) and b) are satisfied, a) said devices are positioned as close as possible to an upper edge of each container, and b) the transverse extension of said devices corresponds to the transverse dimension of each container.

2. The method according to claim 1, further comprising:

applying glue to the bottom of each container by causing a relative longitudinal displacement between the container and the glue application device, and by projecting the glue from above during said displacement, onto the bottom of each container so as to form on said bottom longitudinal strips of glue.

3. Apparatus for automatically gluing a heat shrinkable plastic film onto a bottom of a rigid container from a plurality of containers, each container being open at its upper part and having a rectangular or square horizontal section, the apparatus comprising:

an endless conveyor driven intermittently in a longitudinal direction of advancement, and including a stand-by station at an upstream end part of the conveyor on which containers are successively positioned, and a film application station located downstream from said stand-by station;

a thermo-plastic film application device located above the film application station for applying a section of thermo-plastic film onto the bottom of each container;

a glue application device located above the conveyor between the stand-by station and the film application station for projecting glue onto the bottom of each container during advancement between the stand-by station and the film application station;

means for placing and holding each container in position on the conveyor such that one of the walls of the container is always situated in one and the same vertical and longitudinal plane of reference;

means for measuring for each container the value of at least one of its height and a transverse dimension at the stand-by station; and means for setting as a function of the measured value, at least one of the vertical position and the transverse extension of the glue application device and the plastic film application device, such that at least one of conditions a) and b) are satisfied, a) said two devices are as close as possible to an upper edge of each container, and b) the transverse extension of said devices correspond to the transverse dimension of each container.

4. The apparatus according to claim 3, further comprising a selection station positioned upstream from the stand-by station and comprising a conveyor for supplying containers aligned with the endless conveyor and situated at a level lower than that of the endless conveyor, a lateral urging bar, situated on a first side of the supply conveyor operatively associated with a jack for transverse motion, and cooperating with a fixed longitudinal guide arranged on the opposite second side of the conveyor and defining the vertical and longitudinal plane of reference, the size of the displacement of the lateral urging bar being used as the measurement of the transverse dimension of each container, and means for causing the containers accumulated on the supply conveyor to pass to the stand-by station on the endless conveyor.

5. The apparatus according to claim 4, further comprising at the site of a stand-by station and the film application station respective mobile longitudinal guides, situated on the first side of the endless conveyor, and, on the second opposite side, fixed longitudinal guides aligned along the vertical and longitudinal plane of reference, the positions of the mobile guides of the stations being servo driven to the position of the urging bar so that the mobile guides come into alignment longitudinally at a distance from the opposite fixed guides, which corresponds to the transverse dimension of each container.

6. The apparatus according to claim 3, wherein the stand-by station comprises means for measuring the height of each container.

7. The apparatus according to claim 6, wherein the means for measuring the height of each container comprise a set of superimposed photo-electric cells which are arranged above the conveyor, on one side thereof.

8. The apparatus according to claim 3, wherein the film application station comprises, above the endless conveyor, a horizontal frame which is mounted so as to be vertically adjustable on a base of the apparatus and, above the frame, a horizontal pressing head mounted to be vertically mobile and to pass through a central opening of the frame.

9. The apparatus according to claim 8, wherein the frame has a transverse upstream side which carries vertical nozzles forming part of the glue application device, said nozzles being directed downwards.

10. The apparatus according to claim 9, wherein one vertical nozzle is mounted fixed onto the frame, on a side of the vertical and longitudinal plane of reference, and at least one opposite vertical nozzle is mounted so as to be transversely mobile on the frame via at least one jack, so that the transverse position of the opposite vertical nozzle is adjustable as a function of the transverse dimension of the container that is under the frame.

11. The apparatus according to claim 8, wherein the frame carries means for drawing the plastic film transversely over each container, said means for drawing including a first longitudinal grip in a fixed position, situated on a side of the vertical and longitudinal plane of reference, a second longitudinal grip which is mounted to be transversely mobile on the frame opposite the first fixed grip, the first mobile grip and the second fixed grip structured and arranged to be opened and closed by respective jacks, and the plastic film which is unwound from a lateral roll of film, on passing into a hoisting device, being taken up by the first fixed grip in order to be able to be gripped at its end by the second mobile grip.

12. The apparatus according to claim 11, wherein the frame carries a cutting device for cutting the plastic film, said cutting device comprising a vertical knife situated proximate to the first fixed grip, and rigidly fixed to an endless chain extending horizontally and longitudinally and driven by a motor so as to be able to cut the film transversely after said film has been pressed onto the bottom of the container.

13. The apparatus according to claim 8, wherein the pressing head is rigidly fixed to a vertical arm sliding in a vertical slide rigidly fixed to a bracket attached to vertical endless chains which are supported by the base and which are driven by a motor so that the pressing head may be a) lowered through the central opening of the frame to the inside of the container and press the film onto its bottom to which glue has been applied, and b) raised again above the frame after pressing.

14. The apparatus according to claim 13, wherein the pressing head extendible in the transverse direction, includes, on its lower part, two L-shaped pressing elements, namely one fixed pressing element and one transversely mobile pressing element, each pressing element comprising a respective horizontal plate, a jack and a linking mechanism with pivoting connecting rods and with slides in order to horizontally and transversely displace the mobile pressing element so as to extend or to retract the pressing head in the transverse direction and adapt it to the transverse dimension of a container.

15. The apparatus according to claim 14, wherein the horizontal plates of the respective pressing elements have lower faces which carry layers of foam material.

16. The apparatus according to claim 15, wherein the container is a cardboard box having internal flaps in the bottom which are not joined, and said layers of foam material include in their middle parts, transverse bosses having a width that approximately corresponds to the distance between the edges of the internal flaps.

* * * * *